US008105120B2

(12) United States Patent
Sekels et al.

(10) Patent No.: US 8,105,120 B2
(45) Date of Patent: Jan. 31, 2012

(54) HIGH-CURRENT CONTACT AND ELECTRIC COMPONENT WITH A HIGH-CURRENT CONTACT

(75) Inventors: Dietrich Sekels, Rockenberg (DE); Stefan Becker, Niddatal (DE)

(73) Assignee: Sekels GmbH, Ober-Moerlen (DE)

( * ) Notice: Subject to any disclaimer, the term of this patent is extended or adjusted under 35 U.S.C. 154(b) by 0 days.

(21) Appl. No.: 12/736,321

(22) PCT Filed: Apr. 17, 2009

(86) PCT No.: PCT/DE2009/000526

§ 371 (c)(1),
(2), (4) Date: Sep. 29, 2010

(87) PCT Pub. No.: WO2009/129785

PCT Pub. Date: Oct. 29, 2009

(65) Prior Publication Data

US 2011/0021091 A1 Jan. 27, 2011

(30) Foreign Application Priority Data

Apr. 23, 2008 (DE) ..... 20 2008 005 620 U

(51) Int. Cl.
*H01R 4/02* (2006.01)

(52) U.S. Cl. ..... 439/875

(58) Field of Classification Search ..... 439/875, 439/796–798
See application file for complete search history.

(56) References Cited

U.S. PATENT DOCUMENTS

| | | | | |
|---|---|---|---|---|
| 745,193 | A * | 11/1903 | Kennedy | 439/865 |
| 5,171,169 | A | 12/1992 | Butcher et al. | |
| 5,599,210 | A | 2/1997 | Green | |
| 6,309,260 | B1 | 10/2001 | Shannon | |
| 6,364,720 | B1 | 4/2002 | Liang | |
| 7,785,158 | B1 * | 8/2010 | McCoy et al. | 439/798 |
| 2007/0015052 | A1 | 1/2007 | Munoz et al. | |

FOREIGN PATENT DOCUMENTS

FR 2 888 679 1/2007

OTHER PUBLICATIONS

International Preliminary Report on Patentability dated Nov. 9, 2010 in PCT/DE2009/000526.

* cited by examiner

*Primary Examiner* — Ross Gushi
(74) *Attorney, Agent, or Firm* — Collard & Roe, P.C.

(57) ABSTRACT

The invention relates to a high-current contact (3) wherein several individual, electric conductors (6) of a common electric line (7) are soldered to the contact element (5) individually or in groups. According to the invention, the contact element (5) comprises a plurality of recesses (13) into which the electric conductors (6) are introduced. The soldered connection of the high-current contact (3) can be tested in a simple manner.

5 Claims, 2 Drawing Sheets

HIGH-CURRENT CONTACT AND ELECTRIC COMPONENT WITH A HIGH-CURRENT CONTACT

CROSS REFERENCE TO RELATED APPLICATIONS

Figure 1:
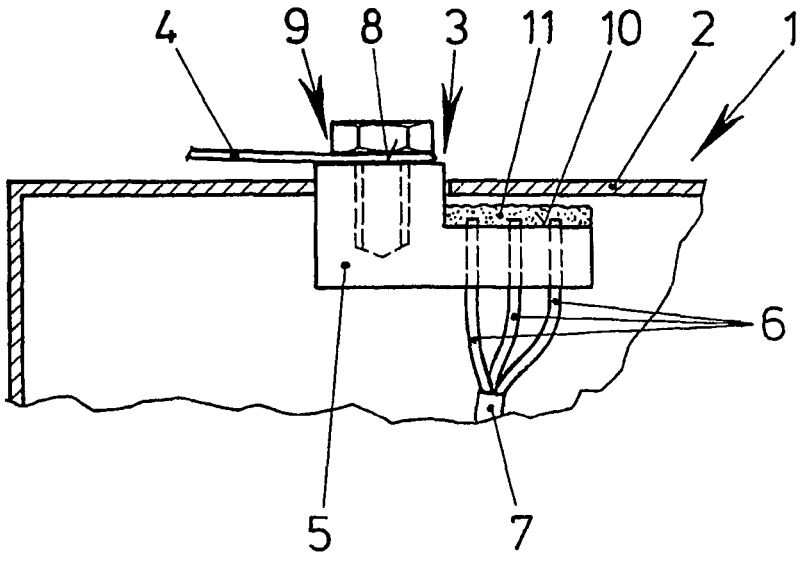

This application is the National Stage of PCT/DE2009/000526 filed on Apr. 17, 2009, which claims priority under 35 U.S.C. §119 of German Application No. 20 2008 005 620.9 filed on Apr. 23, 2008, the disclosure of which is incorporated by reference. The international application under PCT article 21(2) was not published in English.

The invention relates to a high-current contact for connecting an electric line having multiple individual electric conductors to a contact element, and having a soldered connection or welded connection of the electric conductors to the contact element. Furthermore, the invention relates to an electric module having such a high-current contact and having a housing.

Such high-current contacts are frequently used in vehicles and in electric motors, and are known from practice. In the known high-current contact, the contact element has a pot-shaped section that is followed by a screw lug. The screw lug serves for a screw connection with an electric line that goes further. For assembly, a bundle of the electric conductors is introduced into the pot-shaped section. The pot-shaped section is filled with solder, and thus the soldered connection between the electric conductors and the contact element is produced.

It is a disadvantage of the known high-current contact that the soldered connection cannot be tested for enclosed air bubbles, for example. Such enclosed air bubbles, however, lead to an impairment of the soldered connection, and in the most disadvantageous case, this only becomes evident after some time of operation of the high-current contact at high current intensities. The stability of the known high-current contact under mechanical stresses is also low, since the solder must fill large gaps between the bundle of the electric conductors and the pot-shaped section. The large gaps furthermore require a high temperature of the solder. Furthermore, filling the pot-shaped section with solder leads to a very high consumption of solder.

In the case of a welded connection of multiple conductors of an electric line, there is also the problem that only part of the conductors is connected with the contact element.

The invention is based on the problem of further developing a high-current contact of the type stated initially, in such a manner that it allows a reliable electric connection of the electric conductors with the contact element and that the soldered connection or the welded connection can be tested. Furthermore, the invention is based on the problem of creating an electric module having such a high-current contact, which module has a particularly simple structure.

This problem is solved, according to the invention, in that the contact element has multiple recesses, and that the individual electric conductors of the electric line are distributed among the recesses.

By means of this configuration, bundling of all the electric conductors of the electric line is avoided. Instead, the electric conductors are divided up among multiple recesses, and soldered into the recesses. Thus, the risk of a large air bubble in the connection between the contact element and the electric conductors is avoided. By means of the provision of multiple recesses for the electric conductors, the contact element has a particularly great surface area that stands opposite the electric conductors, as compared with a single recess. Thus, even smaller air bubbles in the soldered connection do not lead to impairment of the soldered connection. The soldered connection is divided up into multiple smaller solder points on the recesses, and can therefore easily be checked optically. In the case of a welded connection, the division of the conductors among the recesses leads to a reduction in the risk that some conductors are not connected with the contact element. The welded connection can also be easily checked in this way. Another significant advantage of the invention consists in that the distribution of the individual electric conductors among the recesses leads to a particularly low construction height of the contact element. The high-current contact according to the invention can thereby also be structured in particularly compact manner.

The high-current contact according to the invention has a particularly great mechanical stability, if each of the individual electric conductors is soldered or welded on in its own recess. In this way, cavities on the contact element, which must be filled with solder, are avoided. In the soldered connection, the consumption of solder can also be kept particularly low, since according to the invention, the solder exclusively has to fill individual solder gaps between the conductors and the recesses.

According to another advantageous further development of the invention, the soldered connection or the welded connection can be checked optically, in simple manner, if the recesses and the electric conductors penetrate through the contact element. By means of this configuration, liquid solder can be introduced on one side of the contact element during soldering, and it can be observed when the solder exits at the other end of the contact element. Observation of exiting of the solder is a clear indication that the soldered connection is continuous. The welded connection can be made on one side of the contact element.

A connection of the high-current contact according to the invention with a further electric line is configured in particularly simple manner if the contact element has a screw side with a thread and a contact side with recesses for accommodating the individual electric conductors, and if the contact side has a lower height than the screw side. Preferably, the thread and the recesses for accommodating the individual electric conductors are disposed parallel to one another.

Subsequent work for removing the projecting ends of the electric conductors can be easily avoided, according to another advantageous further development of the invention, if the contact element is flat on one side and is configured in steps on the other side, to produce the different heights of the screw side and the contact side, and if the free ends of the electric conductors project on the stepped side. In this way, narrowing of the region on the thread by the electric conductors passed through the contact element is furthermore avoided.

The contact element can be easily adapted to construction spaces provided, according to another advantageous further development of the invention, if the recesses are disposed in one or more rows.

Corrosion of the electric conductors and of the contact element can be reliably avoided, according to another advantageous further development of the invention, if the stepped side of the contact side is covered with a curing mass. A resin is preferably suitable as a curing mass.

The problem mentioned second, namely the creation of an electric module having an aforementioned high-current contact, which module has a particularly simple structure, is accomplished, according to the invention, in that the stepped side of the contact element faces the outside of the housing, and if the contact element projects out of the housing with the screw side, and if the electric conductors connected with a soldered connection or a welded connection are disposed entirely within the housing. By means of this side, it is avoided that when the high-current contact is screwed in, the ends of the electric conductors disposed within the housing create a problem when the contact element is screwed together with a line that leads further.

The invention permits numerous embodiments. For further clarification of its basic principle, one of them is shown in the drawing and will be described in the following. This drawing shows, in FIG. 1 a partial region of an electric module having a high-current contact according to the invention, FIG. 2 a top view of the high-current contact according to the invention from FIG. 1, FIG. 3 a sectional representation through the high-current contact from FIG. 2, along the line III-III, FIG. 4 a further embodiment of the high-current contact according to the invention, FIG. 5 a sectional view of the high-current contact from FIG. 4 along the line V-V.

FIG. 1 shows a partial region of an electric module 1, for example an electric motor. The module 1 has a housing 2 and a high-current contact 3. An electric line 4 that leads away from the module 1 is connected with the high-current contact 3. The high-current contact 3 has a contact element 5 and multiple individual electric conductors 6 of a common electric line 7 guided within the module 1, which are connected with the contact element 5. The contact element 5 has a screw side 8 for a screw connection 9 with the electric line 4 that leads away from the module 1 and leads further, and a contact side 10 for contacting the individual electric conductors 6. The side of the contact element 5 that faces the outside of the housing 2 is configured in stepped manner, so that the contact element 5 is higher on the screw side 8 than on the contact side 10. The high-current contact 3 projects out of the housing 2 exclusively with the screw side 8 of the contact element 5. The contact element 5 can be made from nickel-plated copper, for example. The contact side 10 is covered with a curable and electrically non-conductive mass 11, for example resin.

Figure 2:
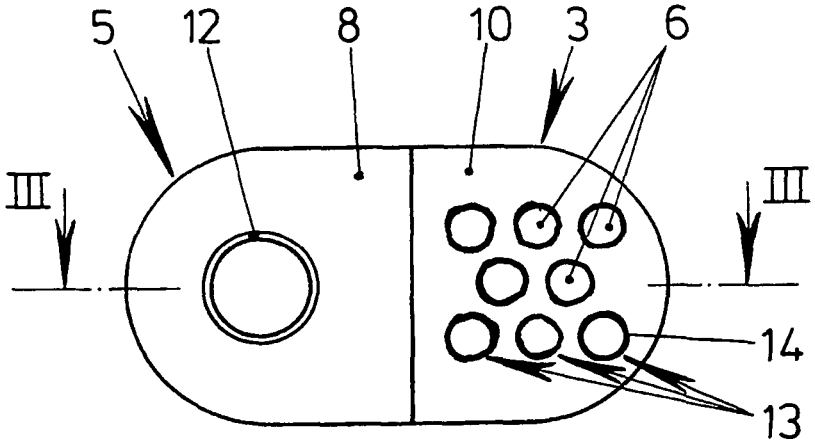

FIG. 2 shows an enlarged view of the high-current contact 3 from FIG. 1 in a top view. In this connection, it can be seen that the screw side 8 has a thread 12 for the screw connection 9 with the electric line 4 that leads away from the module, as shown in FIG. 1. The contact side 10 has a number of recesses 13 that go through, which corresponds to the number of electric conductors 6. The electric conductors 6 are individually attached in the recesses 13, with a soldered connection 14, in each instance, in electrically conductive manner.

Figure 3:
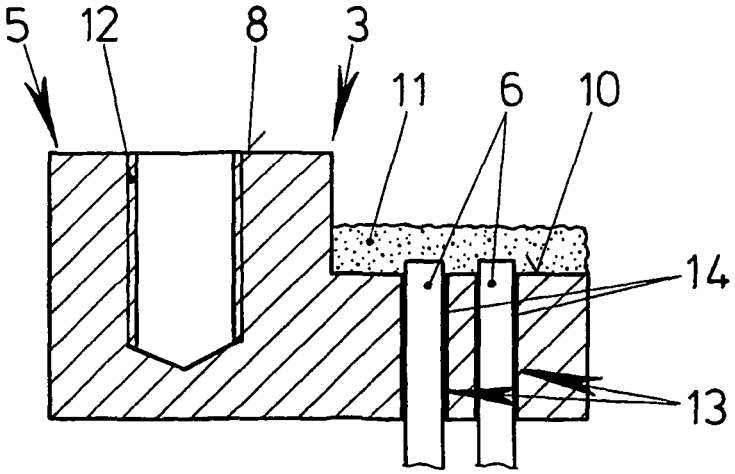

FIG. 3 shows the high-current contact 3 from FIG. 2 in a sectional representation along the line III-III. The thread 12 is disposed in a dead-end bore. The free ends of the electric conductors 6 penetrate the contact element 5 on the contact side 10. Furthermore, the recesses 13 for accommodating the electric conductors 6 are oriented parallel to the thread 12.

Figure 4:
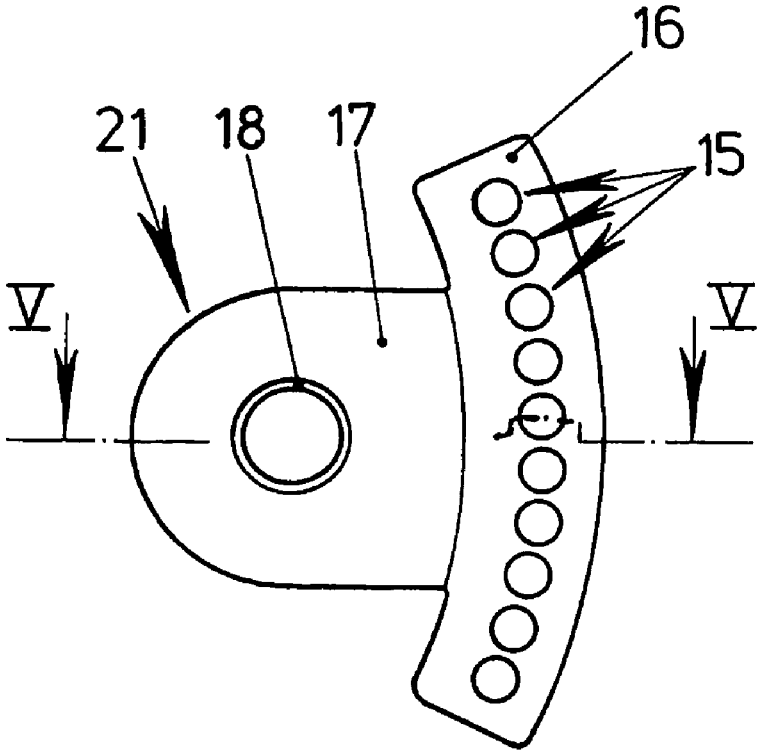
Figure 5:
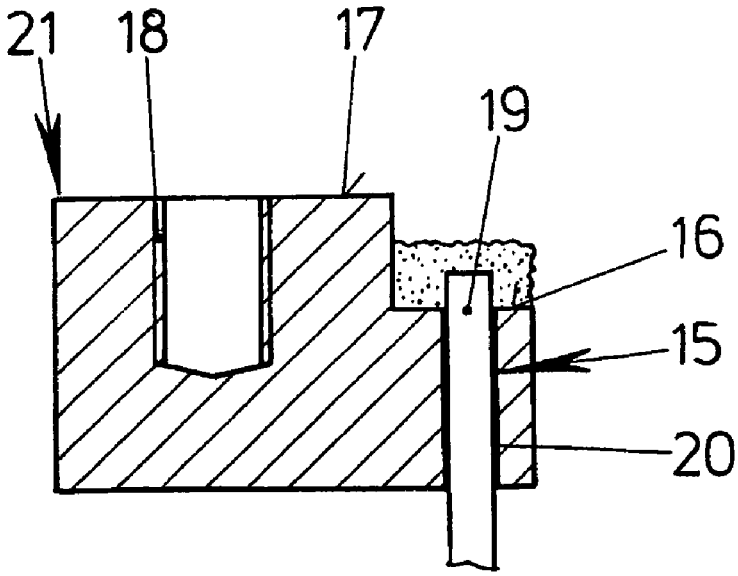

FIG. 4 shows a further embodiment of the high-current contact 3, in which a contact element 21 and multiple recesses 15 are disposed on a contact side 16 in the form of an arc. A screw side 17 is structured in the same way as in the high-current contact from FIGS. 2 and 3, and has a thread 18. FIG. 5 shows the high-current contact 3 from FIG. 4 in a sectional representation along the line V-V. In this connection, it can be seen that as in the embodiment according to FIGS. 2 and 3, an electric conductor 19 is attached in one of the recesses 15, by means of a soldered connection 20, in each instance.

In the case of a welded connection, not shown, the conductors are attached in the recesses by means of electric welding or friction welding, in electrically conductive manner.

The invention claimed is:

1. A high-current contact for connecting an electric line having multiple individual electric conductors to a contact element such that the contact element is capable of having a soldered connection or a welded connection to the electric conductors, the high-current contact comprising:

the contact element, and a curing mass, wherein the contact element has multiple recesses, wherein the multiple individual electric conductors can be distributed among the multiple recesses, wherein the contact element has a screw side with a thread and a contact side for the multiple recesses, wherein the contact side has a lower height than the screw side, wherein the contact element is flat on one side and is configured in steps on the other side to produce the contact side having the lower height than the screw side, wherein free ends of the multiple individual electric conductors can project on the stepped side, and wherein the stepped side of the contact side is covered with the curing mass.

2. The high-current contact according to claim 1, wherein each electric conductor of the multiple individual electric conductors can be soldered or welded in a respective recess of the multiple recesses.

3. The high-current contact according to claim 1, wherein the multiple recesses penetrate through the contact element so that the multiple individual electric conductors can penetrate through the contact element.

4. The high-current contact according to claim 1, wherein the multiple recesses are disposed on one or more rows.

5. An electric module comprising:

a housing, and a high-current contact assembly comprising:

an electric line having multiple individual electric conductors, and a contact element connected to the multiple individual electric conductors via a soldered connection or a welded connection, wherein the contact element has multiple recesses, and wherein the multiple individual electric conductors of the electric line are distributed among the multiple recesses, wherein a stepped side of the contact element faces an outside of the housing, wherein the contact element projects out of the housing with a screw side of the contact element, and wherein the multiple individual electric conductors are disposed entirely within the housing.

* * * * *